United States Patent [19]

Tsuji et al.

[11] 4,187,685

[45] Feb. 12, 1980

[54] METHOD AND SYSTEM FOR EFFECTING CONTROL GOVERNING OF A STEAM TURBINE

[75] Inventors: Kunio Tsuji; Katsukuni Hisano; Akira Sakai, all of Hitachi; Shozo Nakamura, Hitachiohta, all of Japan

[73] Assignee: Hitachi, Ltd., Japan

[21] Appl. No.: 876,944

[22] Filed: Feb. 10, 1978

[30] Foreign Application Priority Data

Feb. 18, 1977 [JP] Japan ..... 52-16897

[51] Int. Cl.[2] ..... F01K 13/02

[52] U.S. Cl. ..... 60/660; 290/52

[58] Field of Search ..... 60/660, 652; 415/13, 415/17, 30, 36; 290/40 R, 40 B, 40 C, 51, 52

[56] References Cited

U.S. PATENT DOCUMENTS

| | | | |
|---|---|---|---|
| 3,097,488 | 7/1963 | Eggenberger | 60/660 |
| 3,998,058 | 12/1976 | Park | 60/652 |

*Primary Examiner*—Allen M. Ostrager
*Attorney, Agent, or Firm*—Craig and Antonelli

[57] ABSTRACT

A method and system for effecting control governing of a steam turbine wherein the steam chamber of a first stage nozzle is divided into a plurality of steam compartments, control valves each connected to one of the steam compartments are individually operated for controlling the flow rate of steam introduced into the turbine, and the governing of the nozzle is effected by adjusting the flow rate of steam in accordance with a load. At low load, the degree of opening of the control valves is kept constant and the turbine is driven by steam of a reduced pressure by reducing the pressure of the steam at the inlet of the turbine so as to maintain, in a low load region, the volume flow rate of steam for a high load region. To cope with a change in the value of the load, the degree of opening corresponding to a predetermined change in the value of the load is set beforehand for each control valve. When the change in the value of the load is smaller than the predetermined change in the value of the load, the degree of opening of the control valve involved is adjusted. Conversely, when the change in the value of the load is greater than the predetermined change in the value of the load, the pressure of the steam at the inlet of the turbine is controlled.

6 Claims, 5 Drawing Figures

METHOD AND SYSTEM FOR EFFECTING CONTROL GOVERNING OF A STEAM TURBINE

This invention relates to the art of effecting control governing of a steam turbine, and more particularly to means for effecting control governing of a steam turbine whereby changes in the value of a load are predicted and an appropriate control valve is actuated to compensate for a change in the load when the turbine is driven by steam of a reduced pressure by reducing the pressure of steam at the inlet of the turbine.

The method for driving a turbine of a fossil fueled generating station by steam of a reduced pressure which has its pressure reduced at the inlet of the turbine is adopted even for large capacity, super-critical pressure fossil fueled generating stations as an operating method aiming at improving heat cycle efficiency at partial load. The first stage nozzle of a steam turbine is usually changed of single-flow construction to multiflow construction when the generating station has a generating capacity of over 700 MW. Regardless of what the construction of the first stage nozzle is it has a nozzle steam chamber disposed in the interior and circumferentially divided into two or four steam compartments so that the nozzle is divided into a plurality of nozzle groups. The control governing of a steam turbine will hereinafter be explained by referring to a steam turbine having a first stage nozzle divided into four steam compartments by way of example. Each of the four steam compartments having a plurality of nozzle groups is connected to each control valve for controlling the quantity of steam supplied to the turbine. When nozzle governing is effected by successively controlling the control valves by opening or closing the same in accordance a desired load at the time the steam turbine is driven by steam of a constant pressure supplied thereto, this control governing method has a disadvantage in that the efficiency of the turbine is reduced at partial load due to a decrease in the volume flow rate of steam caused by the closing of the control valves.

In order to avoid a reduction in the efficiency of the turbine operating at partial load, proposal have been made, as described in an article entitled "Development of the Supercritical Power-Station Unit for Variable Pressure Operation" in "SIEMENS REVIEW", XXXIV (1969), No. 10, to keep open the control valves which would otherwise be closed in nozzle governing and to drive the turbine by steam of a reduced pressure by reducing the pressure of steam supplied to the first stage nozzle when the turbine shifts from an operation at high load to an operation at partial load, so that the volume flow rate of the steam flowing into the turbine will be kept constant to thereby avoid a reduction in the efficiency of the turbine. However, when the turbine is driven by steam of a reduced pressure as aforesaid, the turbine may shift to an operation at high load if the partial load state in which the turbine is driven by steam of a reduced pressure becomes close to the high load state in which nozzle governing is effected with the turbine being driven by steam of a constant pressure. If this occurs under a condition in which some of the control valves closed up to then is opened to let the turbine shift to a nozzle governing operation, then another control valve is slightly opened when the turbine shifts to an operation at high load and the slightly opened control valve is thereafter closed if the turbine shifts to an operation at low load, as the capacity of a transmission system connected to such generating station or the load fluctuates in valve slightly. Repetition of the operation of a control valve in which it is slightly opened and then closed in a short period of time will give rise to the problem of impact being exerted on the control valve when it is closed or of the valve being subjected to vibration caused by the flow of steam therethrough. A change in load from a high load to a low one will necessitate the closing of the control valve which has been open up to then. This will result in no steam flowing into the steam compartment of the first stage nozzle which is associated with the closed control valve. However, since steam of elevated temperature flows to the adjacent steam compartments, the temperature of the first stage nozzle as a whole will become nonuniform circumferentially. By considering the operation of slightly opening a control valve the thermal stress is produced in the first stage nozzle due to a change in temperature which is greater than a change in temperature caused by a change in the value of the load.

The method for effecting control governing of a turbine by steam of a reduced pressure when the turbine operates at partial load so as to avoid a reduction in the efficiency of the turbine is also described in "ASME Paper", No. 62-WA-180, in an article entitled "Improved Station Heat Rate with Variable Pressure Operation" and "AMERICAN POWER CONFERENCE" (1972), in an article entitled "A REVIEW OF SLIDING THROTTLE PRESSURE FOR FOSSIL FUELED STEAM-TURBINE GENERATORS".

An object of this invention is to provide means for effecting control governing of a steam turbine capable of driving the turbine by steam of a reduced pressure, wherein the production of impact or vibration due to the operation of opening and closing a control valve performed when there is a change in the value of a load can be prevented.

Another object is to provide means for effecting control governing of a steam turbine capable of driving the turbine by steam of a reduced pressure, wherein the production of impact or vibration and the production of thermal stress in the first stage nozzle due to the operation of opening and closing a control valve performed when there is a change in the value of a load can be prevented.

The means for effecting control governing of a steam turbine according to the present invention is characterized, in means for effecting control governing of a steam turbine including a first stage nozzle having a steam chamber divided into a plurality of steam compartments each being connected to a control valve for controlling the flow of steam so that nozzle governing is effected by individually opening and closing the control valves, by keeping the control valves open and at the same time driving the turbine by steam of a reduced pressure by reducing the pressure of steam at the inlet of the turbine so as to maintain, at low load, the volume flow rate of steam for high load. Further features of the invention include controlling the degree of opening of the control valve involved when a change in the value of a load is smaller than a preset change in the value of the load and controlling the pressure of steam at the inlet of the turbine when the change in the value of the load is greater than the preset change in the value of the load, in order to cope with such change in the value of the load.

Figure 1:
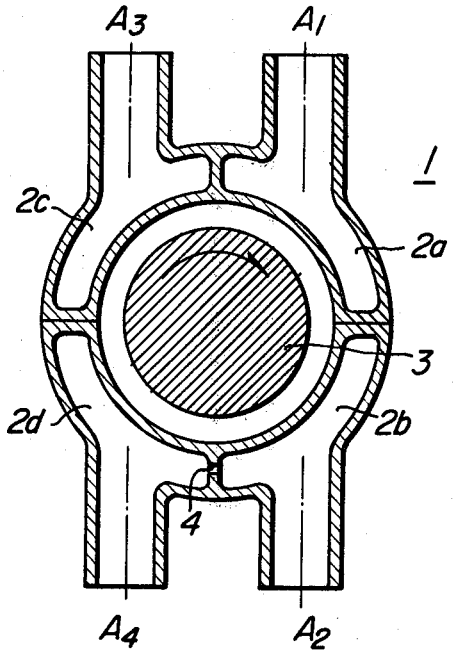
FIG. 1 is a sectional view, taken radially, of the first stage nozzle of a steam turbine as seen from the steam inlet side, in which the present invention can be incorporated.

One embodiment of the invention will now be described by referring to the accompanying drawings. FIG. 1 is a radial sectional view of a first stage nozzle 1 for introducing steam into a turbine. The nozzle 1 has an inlet steam chamber circumferentially divided into four steam compartments *2a, 2b, 2c* and *2d* which communicate with control valves A1, A2, A3 and A4 (not shown) respectively for controlling the flow rate of steam introduced into the nozzle 1. Communicating passage 4 is provided between the steam compartments *2b* and *2d*, and a turbine rotor 3 is arranged on the inner periphery of the first stage nozzle 1.

Figure 2:
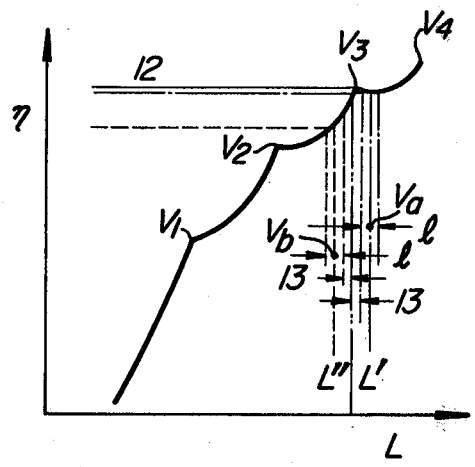
FIG. 2 is a graph showing the relation between load and turbine efficiency which can be obtained when the degree of opening of the control valves is varied by the method for effecting control governing of a steam turbine according to the invention.

FIG. 2 is a graph showing a load-turbine efficiency characteristic 11 which is obtained when the turbine is driven by steam of a constant pressure, with the pressure of the steam flowing through the first stage nozzle 1 into the inlet of the turbine being constant. In the FIGURE, a point V1 is a point at which control valve A1 is fully open, a point V2 is a point at which control valves A1 and A2 are fully open, a point V2 is a point at which control valves A1 to A3 are fully open, and a point V4 is a point at which control valves A1 to A4 are fully open. The lines each connecting the two adjacent points V1 to V4 are curved because of the fact that there is a loss due to throttling of the control valves which will be not full-opened. FIG. 2 also shows a reduced pressure operation characteristic 12 in which the turbine is driven while the pressure of the steam at the inlet of the turbine is reduced under partial load condition of a low region which is below point V3 at which control valves A1 to A3 are fully open. The turbine is driven by steam of a reduced pressure by reducing the pressure of the inflow steam while keeping control valves A1 to A3 fully open so as to prevent a reduction in the volume flow rate of steam, which would otherwise occur when control valve A3 is closed at low load, below the level of the volume flow rate of steam flowing through the turbine while control valves A1 to A3 remain fully open at point V3 when nozzle governing is effected, whereby the volume flow rate of the steam flowing into the turbine can be kept constant and a reduction in the efficiency of the turbine can be avoided. More specifically, if the pressure of the steam at the inlet of the turbine is reduced in a low load region to keep constant the volume flow rate of steam at point V3 at which nozzle governing is effected as shown in a graph in FIG. 3 in which the load L is set forth along the horizontal axis and the steam pressure S is set forth along the vertical axis, the operation of driving the turbine by steam of a reduced pressure offers the advantage of the efficiency of the turbine being improved as compared with the efficiency of the turbine achieved when nozzle governing is effected.

However, the operation of driving the turbine by steam of a reduced pressure as aforementioned has some disadvantages. When the turbine operates at reduced steam pressure in a low load region in the vicinity of an arbitrarily selected point V3 at which control valves A1 to A3 are fully open, a change of the load into a higher load region causes the control valve A4 to slightly open, thereby producing impact of steam exerted on the control valve or vibration of the control valve. Conversely, if the load changes into a lower load region when nozzle governing is effected at the time the load is in a slightly higher load region than point V3, the control valve A4 in a slightly open position will be brought to a closed position, thereby producing thermal stress in the nozzle.

The present invention provides means for effecting control governing of a steam turbine which eliminates the aforementioned disadvantages of operating the turbine at reduced steam pressure. By using means for effecting control governing of a steam turbine shown in FIG. 2 wherein the degree of opening of the control valves is kept constant and the pressure of the steam at the inlet of the turbine is reduced to a level at which the volume flow rate of steam can be kept constant in a low load region below the arbitrarily selected opening point of the control valve, it is impossible to effect control of the operation of the turbine by keeping constant the degree of opening of the control valve involved when very small and suddenly occurring changes take place in the value of the load. Therefore, according to the invention, the degree of opening of the valve is directly corrected and the turbine is made to function in a manner to quickly respond to changes in the load. In order to avoid the problem of production of impact on the control valve and vibration thereof and to prevent changes from occurring in temperature difference between walls of the steam compartments at the inlet of the nozzle which are caused by repeated opening and closing of the control valve, a preset load is established which represents an allowable change in the value of the load, and the turbine is driven by steam of a reduced pressure with the control valve involved being either closed or opened beforehand until the preset load is reached from the opening point of the control valve.

A change l in the value of the load into a higher load region which raises a problem because such change is small and occurs suddenly as shown in FIG. 2 is considered to be different according to fossil fueled generating station. In order to cope with this small and suddenly occuring change in a load L into a higher load region, the degree of opening of the control valve A4 is set beforehand in an opening direction Va as indicated by a dash-and-dot line in FIG. 3, so that a load L' representing one-half the change l in the value of the load L plus a margin 13 of one percent of the rated output of the steam turbine will be applied to the control valve A4, provided that such load L' does not involve the point V3 the control valve A4 is opened slightly in accordance with a change in the value of the load during operation of the turbine, it is possible to avoid impact on the valve A4 and vibration thereof when the valve A4 is closed. Also, by passing steam to the steam compartment *2d* of the first stage nozzle which has a nozzle group connected to the valve A4, it is possible to prevent the production of thermal stress in the first stage nozzle due to a change in the temperature of the steam compartment 2d.

Figure 3:
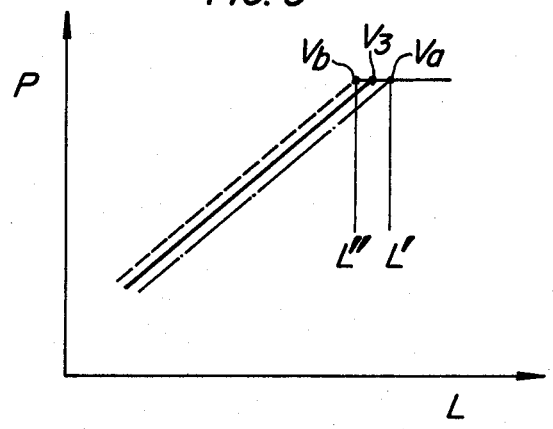
FIG. 3 is a graph showing the relation between load and steam pressure which can be obtained by varying the degree of opening of the conrol valves by the method for effecting control governing of a steam turbine according to the invention.

Conversely, in order to cope with a change in the value of the load L into a lower load region, the control valve A4 is fully closed and the degree of opening of the control valve A3 is set beforehand in a closing direction Vb as indicated by a broken line in FIG. 3, so that a load L″ representing one-half the change l in the value of the Load L plus a margin of one percent of the rated output of the turbine will be applied to the control value A3. If the valve A3 is closed slightly in accordance with a change in the value of the load, the problem of production of impact on the valve A3 and vibration thereof can be more advantageously avoided than in the aforementioned governing means. However, when the turbine is driven by steam of a reduced pressure, the control valve A4 is fully closed, causing the distribution of temperature in the steam chamber of the first stage nozzle to become non-uniform. In order to obviate this disadvantage, the communicating passage 4 is provided between the walls of the steam compartments 2b and 2d associated with the regulating valves A2 and A4 respectively, so as to permit introduction of steam into the compartment 2d to render uniform the distribution of temperature in the steam chamber as a whole.

Figure 4:
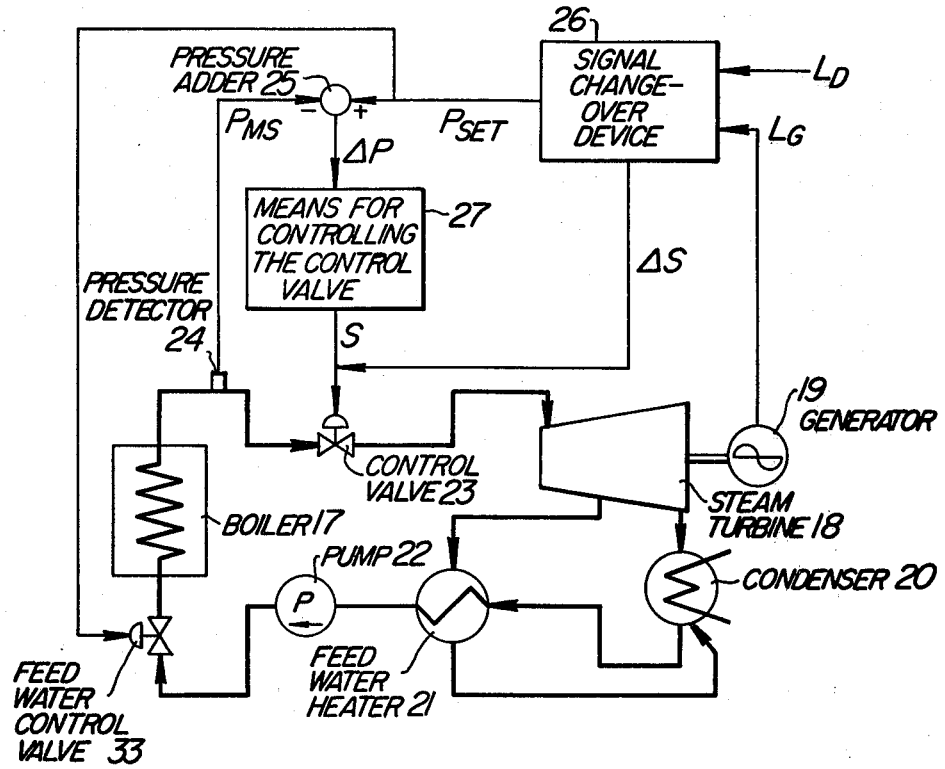
FIG. 4 is a diagrammatic representation of the system for effecting control governing of a steam turbine comprising one embodiment of the invention.
Figure 5:
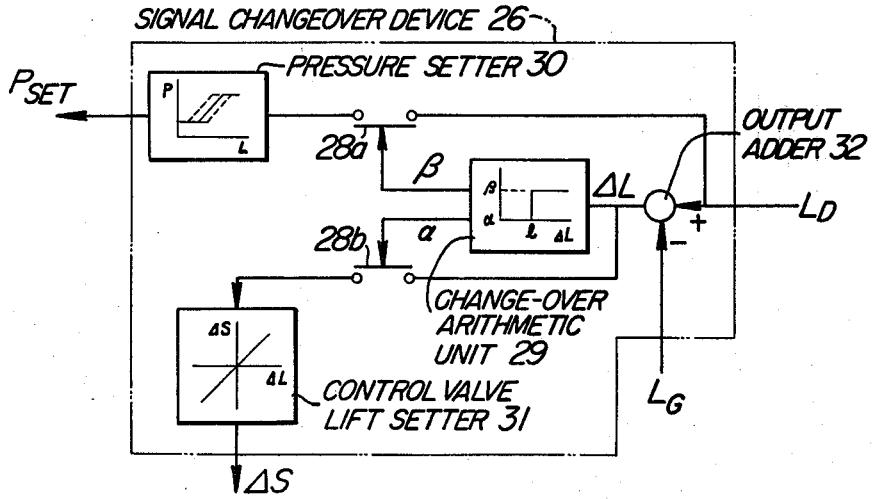
FIG. 5 is a fragmentary detailed view of the system shown in FIG. 4.

The aforementioned effects can be achieved by using a system shown diagrammatically in FIGS. 4 and 5 which show the arrangement of equipment for a fossil fueled generating station, wherein steam produced in a boiler 17 has its quantity controlled by a control valve 23 and is introduced into a steam turbine 18 where the energy of the steam is converted into a mechanical energy to enable a generator 19 to generate an electric power output. The exhaust steam from the steam turbine 18 is condensated into water in a condenser 20 and is used as a feed water heated by a feed water heater 21 and returned to the steam turbine 17 by means of a feed water pump 22. The electric power output can be adjusted by effecting control of the degree of opening of the control valve 23 for controlling the flow of steam into the steam turbine 18. According to the invention, a load demand $L_D$ and a generator output $L_G$ are detected, and the difference between $L_D$ and $L_G$ is calculated by an output adder 32 of a signal change-over device 26 shown in detail in FIG. 5 and a load variation signal ΔL representing the detected difference is produced to actuate a change-over arithmetic unit 29. If the load variation signal Δis below the preset value l, then a signal $\alpha$ is produced to actuate a change-over switch 28b and an operation signal ΔS is calculated in a control valve lift setter 31 by the load variation signal ΔL as input signal and actuates the regulating valve 23 to control the degree of its opening. If the load variation signal ΔL is above the present value l, then a signal $\beta$ is produced to actuate a change-over switch 28a, and a set pressure value $P_{SET}$ for the steam at the inlet of the turbine which is commensurate with the load demand $L_D$ is calculated by a pressure setter 30. The set pressure value $P_{SET}$ is compared at a pressure adder 25 with a steam pressure value $P_{MS}$ at the inlet of the turbine which is detected by a pressure detector 24 for detecting the pressure of the steam led from the boiler 17 to the turbine 18. A differential signal ΔP produced by calculation at the adder 25 is put into the means for controlling the control valves 27 which produces a control valve operating signal S to actuate the regulating valve 23 to control its degree of opening. Also, the flow rate of feed water supplied to the boiler 17 is controlled by means of a feed water control valve 33 in accordance with the set pressure value $P_{SET}$, so as to control the quantity of steam generated by the boiler 17. The same effect can be achieved by controlling the degree of opening of the control valve 23. By the aforementioned arrangement, the pressure of steam at the inlet of the turbine 18 can be controlled to a predetermined level.

The means for effecting control governing of a steam turbine in which the turbine can be operated by steam of a reduced pressure can be made, according to the invention, to achieve the effect of preventing impact or vibration of the control valve involved which would otherwise be caused when the control valve is opened or closed to cope with a small suddenly occurring change in the value of the load.

Also, an incidental effect achieved by the invention is that the means for effecting control governing of a steam turbine is capable of preventing the production of thermal stress in the first stage nozzle of the turbine.

What is claimed is:

1. A method for effecting control governing of a steam turbine having a first stage nozzle including a steam chamber divided into a plurality of steam compartments, and a plurality of control valves each connected to one of said steam compartments and adapted to be individually operated to as to effect the governing of the nozzle by controlling the flow rate of steam introduced into the turbine, such method comprising the steps of:

keeping constant the degree of opening of said control valves at low load operating the steam turbine by steam of a reduced pressure by reducing the pressure of steam at the inlet of the turbine so as to maintain, in a low load region, the volume flow rate of steam for a high load region;

presetting the degree of opening of each of said control valves corresponding to a predetermined change in the value of a load so as to cope with a change in the value of the load;

altering the degree of opening of the control valve involved when the change in the value of the load is smaller than the predetermined change in the value of the load; and controlling the pressure of steam at the inlet of the turbine when the change in the value of the load is greater than the predetermined change in the value of the load.

2. A method for effecting control governing of a steam turbine having a first stage nozzle including a steam chamber divided into a plurality of steam compartments, and a plurality of control valves each connected to one of said steam compartments and adapted to be individually operated so as to effect the governing of the nozzle by controlling the flow rate of steam introduced into the turbine, such method comprised the steps of:

setting a pressure level in accordance with a load demand for adjusting the pressure of steam at the inlet of the turbine so as to keep constant the degree of opening of said control valves and operating the turbine by steam of a reduced pressure to enable the volume flow rate of steam for a high load region to be maintained in a low load region;

comparing a variation in the value of a load, which represents the difference between the load demand and an actual load, with a preset change in the value of the load with regard to a slight change occurring in the value of the load;

altering the degree of opening of the regulating valve involved when said variation in the value of the load is smaller than the preset change in the value of the load; and controlling the pressure of steam at the inlet of the turbine when the variation in the value of the load is greater than the preset change in the value of the load.

3. A method for effecting control governing of a steam turbine as claimed in claim 2, further comprising the steps of keeping closed beforehand the regulating valve involved into a degree corresponding to said slight variation in the value of the load, and keeping constant the degree of opening of said regulating valve with respect to the load.

4. A method for effecting control governing of a steam turbine as claimed in claim 2, further comprising the steps of keeping open beforehand the regulating valve involved to a degree corresponding to said slight variation in the value of the load, and keeping constant the degree of opening of said regulating valve with respect to the load.

5. A system for effecting control governing of a steam turbine having a first stage nozzle including a steam chamber divided into a plurality of steam compartments, and a plurality of regulating valves each connected to one of said steam compartments and adapted to be individually operated so as to effect the governing of the nozzle by controlling the flow rate of steam introduced into the turbine, such system comprising:

adder means for calculating the difference in value between a load demand and an actual load;

a first arithmetic unit for comparing the difference in the value of the load calculated by said adder means with a preset value and producing an output signal;

a second arithmetic unit using said output signal of said first arithmetic unit as an operation signal for calculating and producing a signal for the pressure of steam at the inlet of the turbine in accordance with said load demand;

a third arithmetic unit using said output signal of said first arithmetic unit as an operation signal for calculating and producing an operation signal to be supplied to the control valve involved in accordance with said difference in the value of the load; and a fourth arithmetic unit for comparing the steam pressure signal produced by said second arithmetic unit with an actual steam pressure signal and calculating and producing another operation signal to be supplied to said control valve.

6. A system for effecting control governing of a steam turbine as claimed in claim 5, further comprising an adjusting valve mounted in a feed water line for controlling the quantity of feed water supplied to a boiler in accordance with the steam pressure signal produced by the second arithmetic unit.

* * * * *